US005170770A

United States Patent [19]

Vosloh

[11] Patent Number: 5,170,770

[45] Date of Patent: Dec. 15, 1992

[54] RUBBER BAND REPEATING GUN

[76] Inventor: Bradley L. Vosloh, 5369 Annunciation, New Orleans, La. 70115

[21] Appl. No.: 664,159

[22] Filed: Mar. 4, 1991

[51] Int. Cl.[5] ..... F41B 7/00

[52] U.S. Cl. ..... 124/19; 124/20.1

[58] Field of Search ..... 124/18, 19, 17, 20.1, 124/20.2, 35.1

[56] References Cited

U.S. PATENT DOCUMENTS

| | | | |
|---|---|---|---|
| 1,759,084 | 5/1930 | Baum et al. | 124/19 |
| 1,909,927 | 5/1933 | Beauchamp et al. | 124/19 |
| 2,462,723 | 2/1949 | Crnich | 124/19 |
| 2,529,047 | 11/1950 | Paul | 124/19 |
| 3,437,084 | 4/1969 | Hyter | 124/19 |
| 3,494,345 | 2/1970 | Griffiths | 124/19 |
| 4,308,850 | 1/1982 | Hunter | 124/19 |
| 4,379,445 | 4/1983 | LoBiondo | 124/19 |

FOREIGN PATENT DOCUMENTS

| | | | |
|---|---|---|---|
| 1159349 | 7/1969 | United Kingdom | 124/19 |

*Primary Examiner*—Randolph A. Reese
*Assistant Examiner*—Jeffrey L. Thompson
*Attorney, Agent, or Firm*—Keaty & Keaty

[57] ABSTRACT

The invention relates to a toy gun for projecting elastic bands. The gun is provided with a handle portion, a barrel portion and a trigger assembly. A launching assembly is mounted on the rearwardly extending part of the handle portion and is fixedly attached thereto. A lateral extension of the trigger assembly slides along the upper face of the rearwardly extending part and frictionally contacts the elastic bands which are positioned within a plurality of launching notches formed in the launching assembly at an angle to vertical.

17 Claims, 2 Drawing Sheets

RUBBER BAND REPEATING GUN

BACKGROUND OF THE INVENTION

The present invention relates to a toy gun and, more particularly, to a self-projecting repeating gun for shooting elastic bands from a hand-held gun shaped as a pistol.

Rubber bands have long been used for launching projectiles either by hand or by various types of guns which allow either a single band launching or launching of a plurality of rubber bands in rapid, almost instantaneous succession. The present invention contemplates provision of a toy gun which can shoot rubber bands in a single shot, semi-automatic or fully automatic mode.

SUMMARY OF THE INVENTION

It is therefore a principle object of the present invention to provide a toy gun for shooting rubber bands.

It is a further object of the present invention to provide a toy gun for projecting the elastic bands in a single shot, semi-automatic or automatic mode of launching.

It is still a further object of the present invention to provide a repeating gun for projecting rubber bands which is inexpensive and simple to manufacture.

It is still a further object of the present invention to provide a toy gun which has a minimum of moving parts, thus making it less prone to breaking.

These and other objects of the present invention are achieved by provision of a toy gun which comprises a handle portion having a cavity therein, a barrel portion having a generally U-shaped groove extending along the upper face of the barrel portion, the barrel portion being provided with an upwardly extending abutment shoulder, a trigger assembly moveable within the internal cavity of the handle portion, the trigger assembly having a lateral extension which abuts the abutment shoulder when the trigger assembly is in a non-activated position and a launching assembly which is secured to a rearwardly extending part of the barrel portion in substantially covering relationship thereto. The launching assembly is provided with a plurality of angularly extending notches, each notch being adapted to receive a part of at least one stretched elastic band therein. The trigger assembly is formed with three stepped up shoulders, with the uppermost shoulder being formed as an upper face of a lateral extension of the trigger member. A pair of vertically extending plates are attached in a substantially perpendicular relationship to the rearmost end of the lateral extension and serve as means to release elastic bands positioned within the launching assembly. The trigger assembly is held under tension by a spring means positioned within the groove of the barrel assembly and secured between the trigger member and the stationary barrel assembly. A protection plate covers the depression within which the spring means is positioned to prevent its accidental removal from the depression.

BRIEF DESCRIPTION OF THE DRAWINGS

For a further understanding of the nature and objects of the present invention, reference will be had to the following detailed description of the invention made in conjunction with the accompanying drawings, wherein like reference numerals refer to similar parts throughout the several views and, in which.

DETAILED DESCRIPTION OF THE PREFERRED EMBODIMENT

Figure 1:
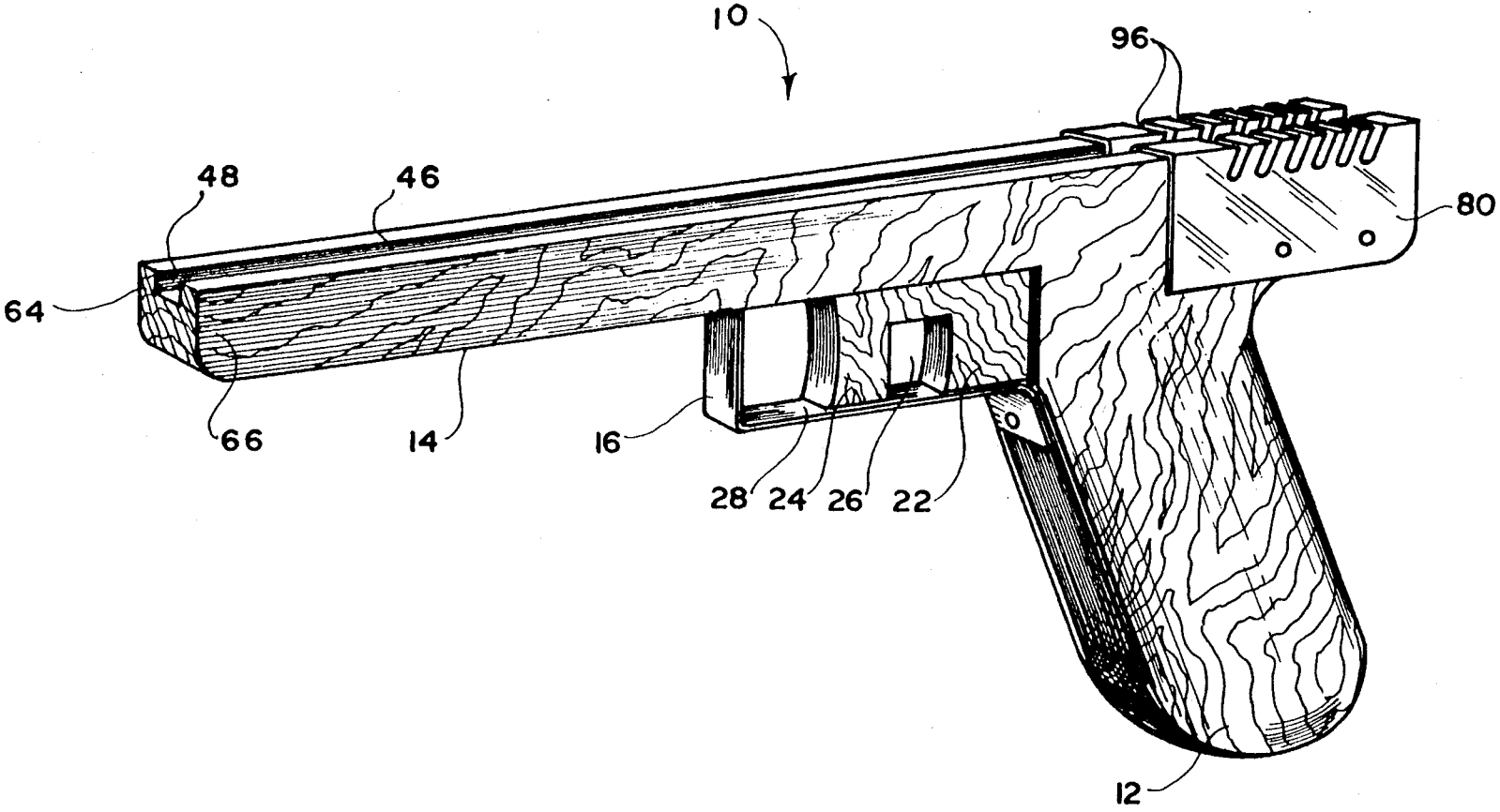
FIG. 1 is a perspective view of the toy gun in accordance with the present invention.

Referring now to the drawings in more detail, numeral 10 designates the toy gun in accordance with the present invention. The gun 10 comprises a handle portion 12, a barrel portion 14, a trigger assembly 16, all elements fixed together to form a unitary casing.

The handle portion 12 is provided with an internal cavity 18 in co-alignment with the direction of rearward and forward movement of the trigger member 20. The trigger assembly comprises the above mentioned trigger member 20, which has a finger engaging portion 22 separated from the finger guard 24 by a cutout 26, and a trigger guard 28. The upper end of the trigger member 20 forms a first shoulder 30, and the upper part of the finger engaging portion 22 forms a second shoulder 32, at a level higher than the first shoulder 30, and a third shoulder 34, at a level still higher than both the shoulders 30 and 32. The shoulders 30, 32, and 34 are oriented in a generally lateral parallel relationship to each other, with the third shoulder 34 continuing as one face of the lateral extension 36, which extends rearwardly from the finger engaging portion 22.

A pair of parallel upwardly extending extension members 38 and 40 extend on opposite ends of the lateral extension 36, adjacent to its most rearward end in generally perpendicular relationship to the plane of the shoulder 34.

A first spring means attachment pin 42 is secured to the second shoulder 32 and projects perpendicularly upwardly therefrom. A part of vertically extending facing wall 23 of the finger engaging part abuts the rear vertically extending end 44 of the barrel portion 14, as will be explained in more detail hereinafter, when the trigger is not activated.

The barrel portion 14 is formed with an elongated U-shaped groove 46 which has a first groove portion 48 and second groove portion 50, which is greater in depth than the first groove portion 48. Secured adjacent the border between the first groove portion 48 and the second groove portion 50 is a second spring means attachment pin 52.

A spring means 54 is secured under tension between the first attachment pin 42 and second attachment pin 52, imposing a forward component on the trigger member 20. The spring means 54 can be an elastic band or other suitable tension means for imposing forward force on the trigger member 20. When the finger engaging portion 22 is engaged by the finger of the user, and a rearward component is imposed on the trigger member 20, the spring means 54 stretches, moving the extensions 38 and 40 away from the barrel 14.

A spring means protection plate 56 is attached, at least at its forward end, to the bottom 58 of the first groove portion 48 by a pin, or nail 60 and extends rearwardly in covering relationship to the spring means 54 to a distance proximate the rear end of the gun 10. In this manner, the spring means 54 is retained within its position in the second groove portion 50, without the possibility of escaping from the groove and causing any damage to the user.

The bottom 58 of the groove portion 48 is in general co-alignment with the third shoulder 34 formed by the trigger member 20, while the bottom 62 of the groove portion 50 is in general co-alignment with the second shoulder 32 of the trigger member 20. Thus, the spring means 54 contracts and expands within the recess formed by the bottom 62 of the groove portion 50 and the second shoulder 32 of the trigger member 20.

As can be seen in the drawings, the barrel portion 14 has a pair of upwardly extending side walls 64 and 66 which, along with the bottom 58 and 62 of the groove portions 48 and 50, respectively, as well as the third shoulder 34 define the recess, or the U-shaped channel 46.

Extending rearwardly from the handle portion 12 is a rearwardly extending part, or support member 72 which, at its forward end, forms a cavity along with internal cavity 18 of the handle portion 12. The support member 72 has an upper face 74 which is laterally aligned with the uppermost limits of the end 44 of barrel 14. The bottom surface 76 of the lateral extension 36 slides along the upper face 74 when the trigger member 20 is moved rearwardly within the trigger guard 28. The end 44 of barrel 14 serves as a limit of forward movement of the trigger member 20 within the trigger guard 28.

Fixedly attached to the part 72 and extending upwardly therefrom is a rubber band launching assembly 80, which comprises a pair of parallel flat side walls 82 and 84, each of which has longitudinal dimensions greater than the longitudinal dimensions of the part 72, such that at least a portion of the side walls 82 and 84 extends beyond the forwardmost limits of the support member 72.

The launching assembly 80 further comprises a transverse connecting member 86 which connects the side walls 82 and 84 and secures them in a fixed relationship to each other. A transverse connecting member 86 is bent to form a depression 88, thus defining, along with the uppermost ends of the side walls 82 and 84, launching stations 92 and 94, with each launching station 94 and 92 being provided with a plurality of notches 96 in spaced-apart generally parallel relationship to each other. The notches 96 are formed at an angle to a vertical plane, inclining slightly forwardly.

Figure 2:
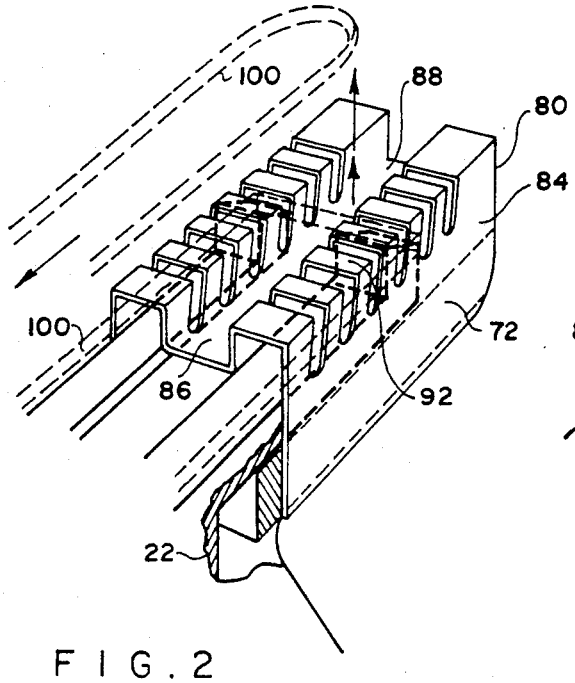
FIG. 2 is a detail view of the launching assembly with rubber bands shown in phantom lines.
Figure 3:
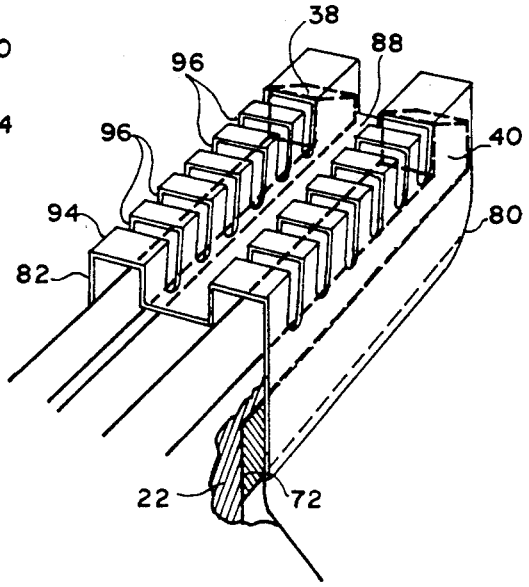
FIG. 3 is a detail view illustrating the launching assembly with trigger member in its most rearward position.
Figure 4:
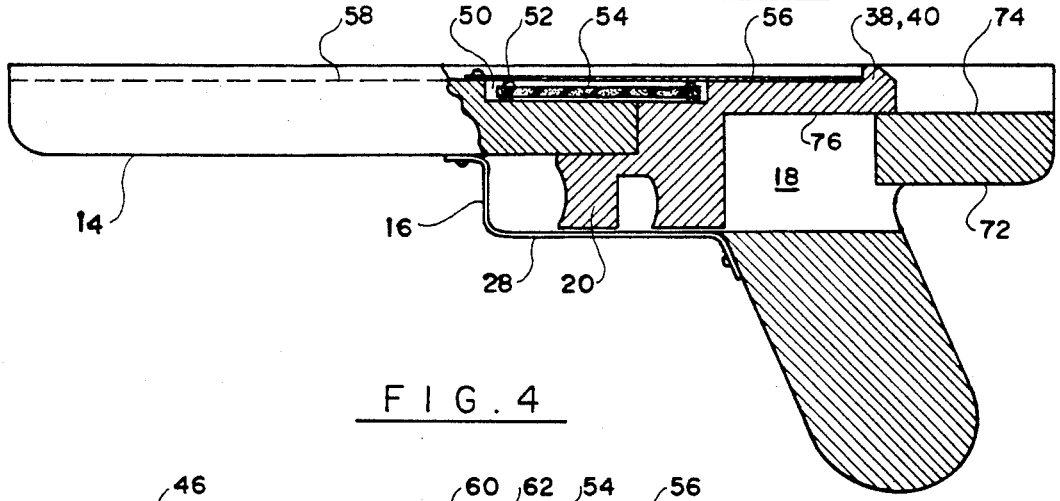
FIG. 4 is a side, partially cross sectional view, illustrating the trigger mechanism in a non-activated position, with launching assembly removed for clarity.
Figure 5:
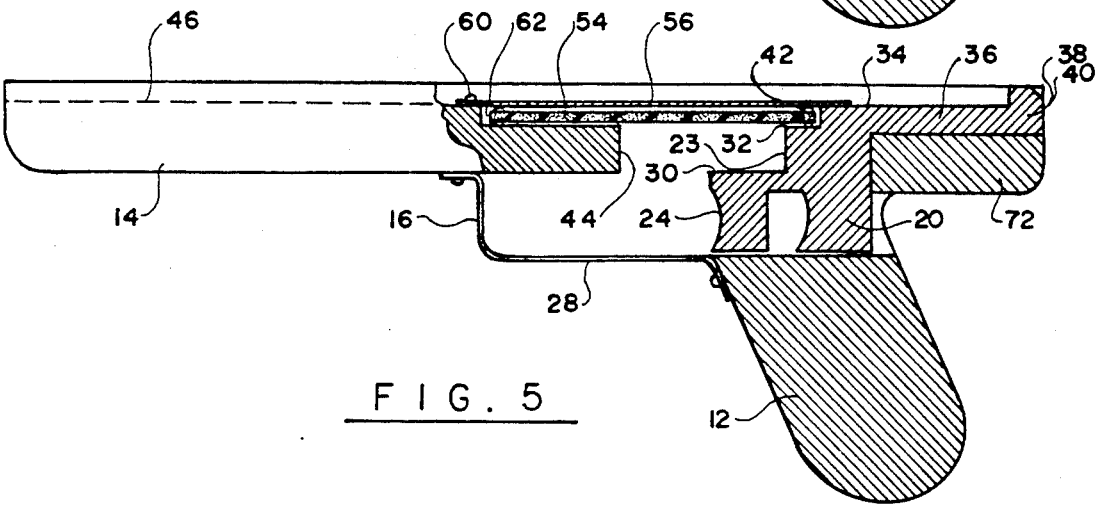
FIG. 5 is a view similar to FIG. 4, but with trigger mechanism activated.

One or more rubber bands 100 are positioned, under tension, within the notches 96, stretching forward to the forward end of the barrel portion 14 and are wrapped about side walls 64 and 66 of the barrel 14. Each notch 96 receives at least one rubber band 100, so that the bands are stretched in one set (as shown in FIG. 2), or two sets (not shown), and are secured to the launching stations 92 and 94 and the opposite plates 38 and 40 of the barrel 14.

The band(s) 100 are wrapped about the side walls 64,66 of the barrel 14 at the forwardmost end(s). If only one set of rubber bands 100 is used, the bands are positioned as shown in FIG. 2, i.e. tensioned between the walls 64 and 66 at their forward ends, and both launching stations 92 and 94 at their distant ends.

If two sets of rubber bands 100 are used, one set is tensioned between notches 96 of the launching 92 at the distant ends and wrapped about the wall 66 at their forward ends, while the second set of the bands is tensioned between the notches of the launching station 94 and the wall 64. Provision of the elongated U-shaped groove 46, therefore, allows to form two separate launching sites 92 and 94 in cooperation with two walls 64 and 66.

In operation, the user pulls back the finger engaging portion 22 of the trigger member 20, causing the lateral extension 36 to move backwardly, thus moving the extensions 38 and 40 below the launching assembly 80. The upper ends of the extensions 38 and 40 slide along or might even slightly frictionally engage the inner surface of the launching stations 92 and 94 of the launching assembly 80, gradually moving from the forwardmost launching notch towards the notch most distant from the forward end of the launching assembly 80. As the upper ends of the extensions 38 and 40 pass through the notches 96, the rubber bands 100, which have been stretched on the launching stations 92 and 94 prior to the triggering action, are released one by one and project from the forward end of the barrel portion 14. Depending on the speed with which the trigger member 20 is moved, the toy gun will release bands in a single, semi-automatic, or automatic manner.

The material from which the toy gun 10 is manufactured can be selected from any number of easily available materials, such as wood, plastic or metal. The physical dimensions of the toy gun 10 can be changed, if so desired, to make it suitable for launching longer or shorter rubber bands. The number of notches 96 can be easily amended to comprise more or less launching notches formed within the launching assembly 80.

Various changes and modifications can be made within the design of the present invention without departing from the spirit thereof. I therefore pray that my rights to the present invention be limited only by the scope of the appended claims.

I claim:

1. A toy gun for projecting elastic bands, comprising:

a handle portion having a cavity therein;

a barrel portion having a generally U-shaped groove extending along an upper face of the barrel portion, said barrel portion being provided with an upwardly extending abutment shoulder;

a trigger assembly movable at least in part within said handle portion cavity, said trigger assembly having a lateral extension with a vertical wall which abuts said abutment shoulder, when the trigger assembly is in a non-activated position, and a spring means mounted within said U-shaped groove for retaining the trigger assembly in a normally non-activated position;

a launching assembly secured to a rearwardly extending part of the barrel portion in substantially covering relationship thereto, said launching assembly being provided with a plurality of angularly extending notches, each notch adapted to receive a part of at least one stretched elastic band therein.

2. The device of claim 1, wherein said groove has a first part and a second part deeper than the first part.

3. The device of claim 1, wherein the trigger assembly comprises a spring means for retaining the trigger member in a normally non-activated position.

4. The device of claim 3, wherein said spring means is an elastic band.

5. The device of claim 1, wherein said launching assembly comprises a pair of parallel vertically extending side walls and a transverse connecting member joining the side walls together.

6. The device of claim 5, wherein said transverse connecting member is formed with a central depression extending along substantially the entire length of the transverse connecting member, said depression dividing the launching assembly into two parallel launching stations.

7. The device of claim 6, wherein each of the launching stations is formed with a plurality of notches, each of the notches extending, at least in part, through the side walls.

8. The device of claim 1, wherein each of said elastic bands is stretched between a angularly extending notch and a forward end of the barrel portion.

9. A toy gun for projecting elastic bands, comprising:

a handle portion having a cavity therein;

a barrel portion having a generally U-shaped groove extending along an upper face of the barrel portion, said groove having a first part and a second part deeper than the first part, said barrel portion being provided with an upwardly extending abutment shoulder;

a trigger assembly movable at least in part within said handle portion cavity, said trigger assembly having a lateral extension which abuts said abutment shoulder, when the trigger assembly is in a non-activated position, said trigger assembly having a trigger member formed with three lateral shoulders extending at different lateral levels, said trigger assembly comprising a spring means for retaining the trigger member in a normally non-activated position;

a launching assembly secured to a rearwardly extending part of the barrel portion in substantially covering relationship thereto, said launching assembly being provided with a plurality of angularly extending notches, each notch adapted to receive a part of at least one stretched elastic band therein; and wherein a first spring means securing pin is positioned in the second part of said U-shaped groove, and a second spring means securing pin is positioned on a lateral middle shoulder of said trigger member, and wherein said spring means is tensed between said first and said second securing pins.

10. A toy gun for projecting elastic bands, comprising:

a handle portion having a cavity therein;

a barrel portion having a generally U-shaped groove extending along an upper face of the barrel portion, said groove having a first part and a second part deeper than the first part, said barrel portion being provided with an upwardly extending abutment shoulder;

a trigger assembly movable at least in part within said handle portion cavity, said trigger assembly having a lateral extension with a vertical wall which abuts said abutment shoulder, when the trigger assembly is in a non-activated position, and a trigger member formed with three lateral shoulders extending at different vertical elevations, said trigger assembly comprising a spring means for retaining the trigger member in a normally non-activated position;

a launching assembly secured to a rearwardly extending part of the barrel portion in substantially covering relationship thereto, said launching assembly being provided with a plurality of angularly extending notches, each notch adapted to receive a part of at least one stretched elastic band therein; and a protection plate extending over the spring means and resting, at least in part, in the first part of the U-shaped groove.

11. A toy gun for projecting elastic bands, comprising:

a handle portion having a cavity therein;

a barrel portion having a generally U-shaped groove extending along an upper face of the barrel portion, said barrel portion being provided with an upwardly extending abutment shoulder, a trigger assembly movable at least in part within said handle portion cavity, said trigger assembly having a lateral extension with a vertical wall which abuts said abutment shoulder, when the trigger assembly is in a non-activated position;

a launching assembly secured to a rearwardly extending part of the barrel portion in substantially covering relationship thereto, said launching assembly being provided with a plurality of angularly extending notches, each notch adapted to receive a part of at least one stretched elastic band therein; and wherein said lateral extension of the trigger assembly is provided with a pair of parallel spaced-apart vertically extending plates at a rearmost end thereof.

12. The device of claim 11, wherein said lateral extension of the trigger assembly slides along an upper face of the rearwardly extending part of the barrel portion, when said trigger assembly is activated.

13. The device of claim 11, wherein said vertically extending plates move under the launching assembly and frictionally contact the elastic band(s) positioned in a stretched condition in a respective notch, releasing the elastic band(s), so as to project the elastic band(s).

14. A toy gun for projecting elastic bands, comprising:

a handle portion having a cavity therein, said handle portion having a rearwardly extending part having an upper face;

a barrel portion having a generally U-shaped groove extending along an upper face of the barrel portion, said barrel portion being provided with an upwardly extending abutment shoulder, said U-shaped groove having a first portion and a second portion, which is deeper than the first portion;

a trigger assembly movable at least in part within said handle portion cavity of the handle portion, said trigger assembly having a lateral extension with a vertical wall which abuts said abutment shoulder, when the trigger assembly is in a non-activated position, a bottom surface of the lateral extension sliding along the upper face of the rearwardly extending part of the handle portion, said lateral extension being provided with a pair of parallel spaced-apart vertically extending plates at a rearmost end thereof; and a launching assembly secured to a rearwardly extending part of the barrel portion in substantially covering relationship thereto, said launching assembly being provided with a plurality of angularly extending notches, each notch adapted to receive a part of at least one stretched elastic band therein, said launching assembly comprising a pair of vertically extending side walls and a transverse connecting member joining the side walls together, the transverse connecting member being formed with a central depression extending along substantially the entire length of the transverse connecting member, said depression dividing the launching assembly into two parallel launching stations, and wherein the vertically extending plates of the trigger assembly move under the launching assembly and frictionally contact the elastic bands positioned in a stretched condition in the notches, releasing the elastic bands, so as to project the elastic bands.

15. The device of claim 14, wherein said trigger assembly has a trigger member formed with three lateral shoulders extending at different vertical elevations.

16. The device of claim 15, further comprising a spring means for retaining the trigger assembly in a normally non-activated position.

17. The device of claim 16, wherein a first spring means securing pin is positioned in the second part of said U-shaped groove, and a second spring means securing pin is positioned on the lateral middle shoulder of said trigger member, and wherein said spring means is tensed between said first and said second securing pins.

* * * * *